US005564228A

United States Patent [19]

Geringer et al.

[11] Patent Number: 5,564,228

[45] Date of Patent: Oct. 15, 1996

[54] PRESSURE-ACTUATED EXIT DOOR ACCESS BAR FOR AN ELECTRONIC DELAYED EGRESS LOCKING SYSTEM

[76] Inventors: Arthur Geringer, 5029 E. Jacobs Ct., Agoura, Calif. 91301; Richard Geringer, 12628 Ambermeadow St., Moorpark, Calif. 93021; David Geringer, 28364 Balkin, Agoura, Calif. 91301

[21] Appl. No.: 140,942

[22] Filed: Oct. 25, 1993

[51] Int. Cl.[6] ..... E05F 15/10

[52] U.S. Cl. ..... 49/32

[58] Field of Search ..... 49/32, 31, 280

[56] References Cited

U.S. PATENT DOCUMENTS

| | | | |
|---|---|---|---|
| 1,684,704 | 9/1928 | Hubbell | 49/32 X |
| 2,926,013 | 2/1960 | Van Dongen | 49/32 X |
| 3,020,038 | 2/1962 | Simpson | 49/32 |
| 4,040,144 | 8/1977 | Lasier et al. | 49/32 X |

*Primary Examiner*—Jerry Redman
*Attorney, Agent, or Firm*—John J. Posta, Jr.

[57] ABSTRACT

An improved pressure-actuated control bar is disclosed which may be located on a door to control access or egress through the door, whereby the control bar is used to trigger unlocking or opening, or both unlocking and opening, of the door following pressure being exerted on the control bar by an individual desiring access or egress through the door. A comparator is used to determine whether pressure exerted on the control bar and sensed by a pressure-sensitive component with no moving parts is sufficient to trigger unlocking or opening, or both unlocking and opening, of the door. A second embodiment describes a push/pull door access handle which may be used on a handicapped-accessible door to initiate powered opening of the door when the handle is pulled, and to cause immediate cessation of the opening of the door when the handle is pushed.

42 Claims, 5 Drawing Sheets

PRESSURE-ACTUATED EXIT DOOR ACCESS BAR FOR AN ELECTRONIC DELAYED EGRESS LOCKING SYSTEM

BACKGROUND OF THE INVENTION

FIELD OF THE INVENTION

The present invention relates generally to electrically operated door access systems in which the door is either unlocked or opened, or both unlocked and opened, by accessing an electronic control system, and more particularly to an improved pressure-actuated control bar or handle which may be located on a door through which access is controlled by the electrically operated door access system, whereby the pressure-actuated control bar is used to trigger unlocking or opening, or both unlocking and opening, of the door following pressure being exerted on the pressure-actuated control bar by an individual desiring access or egress through the door.

Hardware and systems for controlling egress and access through doors may predominantly be classified into one of two categories. The first category is that of hardware and systems which are designed to limit and control access and egress through doors. Devices falling into this classification are generally utilized for theft-prevention or to establish a secured area into which (or from which) entry is limited. The second category is that of hardware and systems which are designed to facilitate access through doors by opening the doors in a manner not requiring great strength or facility by the person desiring access.. Devices falling into this second classification are used to automate the opening of a door in an easy, yet controlled, manner suitable for use by handicapped individuals, for example.

The first of these two categories includes controlled access security doors and operating systems for such doors. Such doors and systems have evolved over the years from simple doors having heavy duty mechanical locks thereon to sophisticated egress and access control devices. In bygone times, heavy duty chains and locks were the norm on security doors which were not generally used, or which were used to prevent theft or vandalism. However, fire codes have made such relatively simple door locking systems obsolete, at least in most developed countries. Emergency exit doors are required by law to be provided in all commercial buildings, and such doors must be operative in the event of a fire, earthquake, or other emergency.

These exit doors are typically provided with heavy horizontal push bars which unlock the door upon actuation and which may provide an alarm of some sort. The early alarms on such doors were either mechanical in nature, such as wind-up alarms contained on the push bar mechanism, or completely separate electrical circuits actuated by a switch opened as the door was opened. Accordingly, egress from such doors was immediate, and, although egress was accompanied by an alarm, typically the person leaving through the door was long gone by the time security personnel arrived.

Many stores suffer great losses through emergency doors, with thieves escaping cleanly through the emergency doors with valuable merchandise. In addition, industrial companies also suffer pilferage of valuable equipment and merchandise through such emergency exit doors. While one solution is to have a greater number of security personnel patrolling the emergency exit doors, to do so is also an expensive solution.

As might be expected, the art reflects a number of emergency exit access activation devices which attempt to solve this problem. A first type of device is found in U.S. Pat. No. 4,257,631, to Logan, Jr., which describes a system activated by a push bar which, upon depression, moves a switch carried by the door to sound an alarm and start a timer delay. After the delay, the door is unlocked.

This type of device in which a push bar containing an electrical switch therein is used to initiate a request for access or egress is by far the most common. It has not always been viewed as the optimum solution, however, due to the difficulty in making it durable and long lasting in addition to being relatively simple and inexpensive. Several other types of systems have been proposed, and, although none of these systems has found great acceptance, a brief discussion of them is in order.

U.S. Pat. No. 4,328,985 and U.S. Pat. No. 4,354,699, both also to Logan, teach a hydraulic system for accomplishing the delay prior to unlocking the door, and a retrofit locking device of the same type which is usable with any door latching system, respectively. These two systems are thus mechanical rather than electrical in nature.

U.S. Pat. No. 4,652,028 and U.S. Pat. No. 4,720,128, to Logan et al. and to Logan, Jr., et al., respectively, teach an electromagnet mounted on a door jamb, an armature on the door held by the electromagnet to retain the door in the closed position, and a switch mounted near the electromagnet which is used to indicate when the door is being opened or tampered with. The Logan, Jr. et al. '128 patent also adds a set of contacts to confirm that the armature properly contacts the electromagnet. These systems have no switch located in a door access bar.

As mentioned above, the second category of hardware and systems includes devices and systems which are designed to facilitate access through doors by opening the doors in a manner not requiring great strength or facility by the person desiring access. One example of such a device is the type of door commonly found in supermarkets, which is typically radar controlled. Another example is a power actuated door in a hospital corridor, wherein when a wall switch is depressed the door automatically opens.

Both of the two categories of devices discussed above are beneficial, yet both categories of devices still possess several disadvantages and are illustrative of problems inherent in the art. For example, the preferred type of door access bar, the type containing an electrical switch therein, has several disadvantages. First, in order for the switching mechanism to operate, there must be a minimal amount of free movement in the bar. The use of a limit switch in the bar requires the switch to be precisely adjusted to operate properly. In addition, one or more springs must be utilized in order to keep the switches in the open position when the door access bar is not being depressed. In addition, the presently known electrical switch type door access bar is mechanically fairly complex, and not inexpensive to manufacture.

Referring now to the automatic door opening mechanisms discussed above, there are also problems in the implementation insofar as these devices may be used by handicapped persons. This is because the types of automatic doors discussed above do not automatically stop once they begin to open. In addition, such devices do not comply with safety regulations such as those found in The Americans With Disabilities Act, and thus are no longer be commercially competitive. This Act and related requirements direct that the doors must be stoppable in an intermediate position upon the exertion of a minimal force.

It is accordingly the primary objective of the present invention that it present a door access bar which has a greatly improved electromechanical mechanism through which mechanical contact by a user with the door access bar is translated into an electrical output which may be utilized to initiate the process of unlocking the door on which the door access bar is located. In this regard, it is a closely related objective of the present invention that the conventional limit switch mechanism be entirely replaced with a different type of switch mechanism which is more dependable and long lasting than conventional limit switches, and which also requires no adjustment throughout its lifetime.

It is a further objective of the door access bar of the present invention that it require only minimal movement of the door access bar to initiate the electrical output indicating a desire for access or egress. In addition, it is desired that the conventional coiled springs used in door access bars be eliminated in favor of an improved mechanical design. It is a related objective that only a slight degree of force need be applied to the door access bar in order to obtain its electrical output. It is a further objective of the present invention that the minimum amount of force required to initiate the electrical output required to indicate a desire for access or egress be fully adjustable over an appreciable range of force.

It is another principal objective of the improved door access bar mechanism of the present invention that it be adaptable for use as a control mechanism for operating an automatically opening door of the type used by handicapped individuals. It is a closely related objective that the switch mechanism contained in the door access bar of the present invention be adaptable as a push/pull door access handle to control both the opening of a door when the door access handle is pulled, as well as the stopping, in an intermediate position, of the door when the door access handle is pushed. The adapted door access handle must require only a minimal force to actuate it in either the pushing movement or the pulling movement thereof in order to safely meet the needs of the handicapped, as well as to meet the requirements of The Americans With Disabilities Act.

The door access bar or handle of the present invention must also be of a construction which is both durable and long lasting, and it should also require little or no maintenance to be provided by the user. In order to enhance the market appeal of the door access bar or handle of the present invention, it should also be of inexpensive construction to thereby afford it the broadest possible market. Finally, it is also an objective that all of the aforesaid advantages and objectives of the present invention be achieved without incurring any substantial relative disadvantage.

SUMMARY OF THE INVENTION

The disadvantages and limitations of the background art discussed above are overcome by the present invention. With this invention, a novel electromechanical switch element is utilized in a door access bar or handle to replace the conventional limit switch. This electromechanical switch element is a force sensing resistor, which has a resistance which drops when a compressive force exerted across the force sensing resistor increases.

The force sensing resistor is placed in series with a reference resistor having a fixed resistance, with an essentially constant voltage placed across the force sensing resistor and the reference resistor. The voltage between the force sensing resistor and the reference resistor will thus increase as force is applied to the force sensing resistor, since its resistance will drop and leave a larger portion of the voltage across the reference resistor.

The voltage between the force sensing resistor and the reference resistor may be applied to a comparator having a predetermined reference voltage. When the voltage between the force sensing resistor and the reference resistor reaches the reference voltage, the comparator provides an electrical output which is used to indicate a desire for access or egress through a door on which the door access bar is mounted. The amount of force needed to be applied to the sensor bar to trigger an output from the comparator may be adjusted by varying the reference voltage. Various other components known in the art may be involved in actually operating the door.

In the preferred embodiment, a hollow sensor bar is supported at the ends thereof above two mounting members mounted on a door. A force sensing resistor is located between each end of the sensor bar and the mounting member located at that end of the sensor bar. In the preferred embodiment, a resilient silicone rubber disc is used between one side of each of the force sensing resistors and either the sensor bar or the mounting member which is adjacent that side of the relevant force sensing resistor.

A circuit board may desirably be located within the sensor bar, the circuit board being electrically connected to the two force sensing resistors and a source of power. The comparator circuit mentioned above is present on the circuit board. In addition, if desired, provision may be made on the circuit board for adjusting the reference voltage supplied to the comparator, thus enabling the amount of force required to produce an output from the comparator to be adjusted. An electrical output from the circuit board is supplied to the door lock operational system, which is not a part of the present invention, and which is well known in the art.

When the sensor bar is depressed, one or both of the force sensing resistors will have a compressive force placed thereon, which force will change its or their resistance. If sufficient pressure is placed on the sensor bar, the comparator will be caused to provide an electrical output indicating a desire for access or egress through the door on which the door access bar is located.

In a related but different implementation, a door access handle is used instead of the door access bar. A sensor handle is connected to and spaced away from a flat sensor plate with cylindrical posts or the like. The sensor plate is mounted within a housing having a front side and a back side, with the back side of the housing being mounted on a door. The cylindrical posts extend through apertures in the front side of the housing.

One or more force sensing resistors are mounted on the back side of the sensor plate facing the back side of the housing. Similarly, one or more force sensing resistors are mounted on the front side of the sensor plate facing the front side of the housing. Silicone rubber discs are placed between one side of each of the force sensing resistors and the housing.

It will be appreciated by those skilled in the art that when the sensor handle is pushed, the one or more force sensing resistors mounted on the back side of the sensor plate facing the back side of the housing will change in resistance. Similarly, when the sensor handle is pulled, the one or more force sensing resistors mounted on the front side of the sensor plate facing the front side of the housing will change in resistance.

Thus, the door access handle may be used with a pair of comparators to provide electrical indications when the door access handle is pushed or pulled using a minimal amount of force. By coupling the output of the comparator indicating that the door access handle is being pulled to an opening actuator, the door on which the door access handle is mounted can be opened when the door access handle is pulled. By coupling the output of the comparator indicating that the door access handle is being pushed to a kill circuit, the opening movement of the door can be stopped when the door access handle is pushed.

It may therefore be seen that the present invention teaches a door access bar which has a greatly improved electromechanical mechanism through which mechanical contact by a user with the door access bar is translated into an electrical output which may be utilized to initiate the process of unlocking the door on which the door access bar is located. In this regard, in the door access bar of the present invention, the conventional limit switch mechanism has been replaced with a different type of switch mechanism which is more dependable and long lasting than conventional limit switches, and which also requires no adjustment throughout its lifetime.

The door access bar of the present invention also requires only minimal movement to initiate the electrical output indicating a desire for access or egress. In addition, the coiled springs conventionally used in door access bars have been eliminated in favor of an improved minimal movement mechanical design. Only a slight degree of force need be applied to the door access bar in order to obtain its electrical output. The minimum amount of force required to initiate the electrical output required to indicate a desire for access or egress is also fully adjustable over an appreciable range.

In another significant characteristic, the improved door access bar mechanism of the present invention is adaptable for use as a control mechanism for operating an automatically opening door of the type used by handicapped individuals. The switch mechanism contained in the door access bar is adaptable to manufacture as a push/pull door access handle which controls both the opening of a door when the door access handle is pulled, as well as the stopping, in an intermediate position, of the door when the door access handle is pushed. The adapted door access handle requires only a minimal force to actuate it in either the pushing movement or the pulling movement thereof, thereby safely meeting the needs of the handicapped, as well as meeting the requirements of The Americans With Disabilities Act.

Both door access bar or handle of the present invention also is of a construction which is both durable and long lasting, and it also requires little or no maintenance to be provided by the user. It is of inexpensive construction, thereby affording it significant economic advantage and access to the broadest possible market. Finally, all of the aforesaid advantages and objectives of the present invention are achieved without incurring any substantial relative disadvantage.

DESCRIPTION OF THE DRAWINGS

These and other advantages of the present invention are best understood with reference to the drawings, in which.

DETAILED DESCRIPTION OF THE PREFERRED EMBODIMENT

The preferred embodiment of the present invention is embodied in a door access bar illustrated in FIGS. 1 through 16. This door access bar may be used as the means to request access or egress through a door on which the door access bar is located, which door is locked by an electrically-operated lock of conventional design. When the door access bar is pressed, control circuitry connected to the door access bar provides an electrical output signal indicating that access or egress through the door is being requested.

Figure 1:
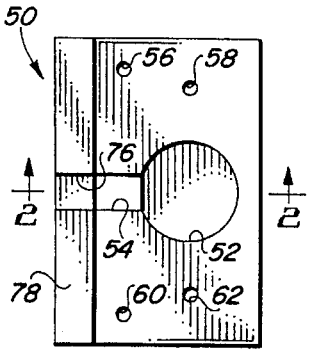
FIG. 1 is a front plan view of a mounting member for installation onto a door, one of which mounting members will be used to support a sensor bar (not shown) at each end thereof, showing a cylindrical recess located therein and a slot extending therethrough.
Figure 2:
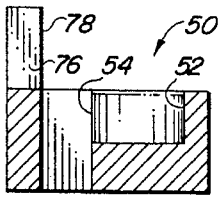
FIG. 2 is a cross-sectional view of the mounting member illustrated in FIG. 1, showing the cylindrical recess therein and the slot extending therethrough.

Referring first to FIGS. 1 and 2, a mounting member 50 is illustrated. The mounting member 50 has a cylindrical recess 52 located in the front side thereof, which cylindrical recess 52 does not extend through the mounting member 50. The mounting member 50 has a slot 54 which does extend entirely through the mounting member 50. The slot 54 is in communication with the side of the cylindrical recess 52 in the mounting member 50, as better shown in FIG. 2.

Also located in the mounting member 50 are four tapped apertures 56, 58, 60, and 62. The tapped apertures 56, 58, 60, and 62 will be used to align two other components to be discussed below in the proper position with respect to the mounting member 50.

Figure 4:
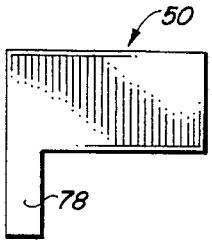
FIG. 4 is a top end view of the mounting member illustrated in FIG. 3.
Figure 3:
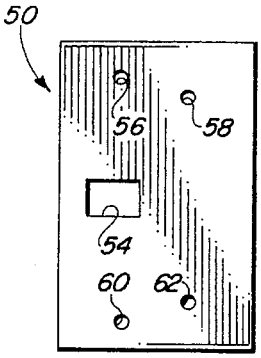
FIG. 3 is a rear plan view of the mounting member illustrated in FIGS. 1 and 2, showing a slot extending therethrough.
Figure 5:
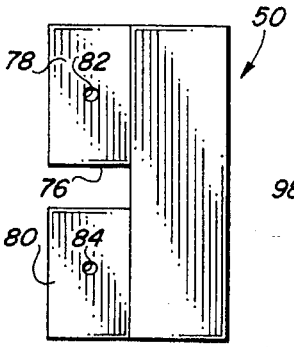
FIG. 5 is a side view of the mounting member illustrated in FIGS. 2 and 4, showing a pair of bracket ends extending orthogonally from the side of the mounting member illustrated in FIGS. 1 and 2, the bracket ends each having a threaded aperture therein.

Referrring now to FIGS. 3 through 5, other views of the member 50 (FIG. 1) are illustrated. The mounting member 90 is L-shaped in cross-section, as shown in FIG. 4, and is sized to fit over the mounting member 50 as best shown in FIG. 3. The mounting member 50 has four apertures 56, 58, 60, and 72 located therein and extending therethrough.

A slot 76 is located in the mounting member 50. The slot 76 entirely divides the side of the L forming the mounting member 50 away from the cylindrical aperture 74 into two bracket ends 78 and 80, as shown in FIG. 5. A threaded aperture 82 is located in the bracket end 78 of the mounting member 50, as shown in FIG. 5. Similarly, a threaded aperture 84 is located in the bracket end 80 of the mounting member 50.

Figure 6:
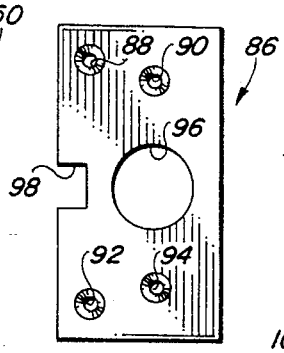
FIG. 6 is a front plan view of a trigger coverplate which will be mounted over the mounting member illustrated in FIGS. 3 through 5, showing a cylindrical aperture located therein and a Slot located in one side thereof.

Referring next to FIG. 6, a trigger coverplate 86 is illustrated. The trigger coverplate 86 is essentially flat, and is sized to fit over the front side of the mounting member 50 (FIG. 1), covering the front side of the mounting member 56 adjacent to the bracket ends 78 and 80 of the mounting member 50. The trigger coverplate 86 has four countersunk apertures 88, 90, 92, and 94 located therein and extending therethrough. When the trigger coverplate 86 is placed over the front of the mounting member 50, the countersunk aperture 88 in the trigger coverplate 86 will be axially aligned with the aperture 50 in the mounting member 50, the countersunk aperture 90 in the trigger coverplate 86 will be axially aligned with the aperture 58 in the mounting member 50, the countersunk aperture 92 in the trigger coverplate 86 will be axially aligned with the aperture 60 in the mounting member 50, and the countersunk aperture 94 in the trigger coverplate 86 will be axially aligned with the aperture 62 in the mounting member 50.

A cylindrical aperture 96 extends through the trigger coverplate 86. The cylindrical aperture 96 is of a smaller diameter than the diameter of the cylindrical recess 52 of the mounting member 50 (FIG. 1). When the trigger coverplate 86 is aligned with the mounting bracket 64, the cylindrical aperture 96 in the trigger coverplate 86 will be concentric with the cylindrical recess 52 in the mounting member 50.

A slot 98 is located in the trigger coverplate 86, which slot 98 is in communication with the edge of the trigger coverplate 86, but is not in communication with the side of the cylindrical aperture 96 in the trigger coverplate 86. When the trigger coverplate 86 is aligned with the mounting member 50 (FIG. 1), the slot 98 in the trigger coverplate 86 will be aligned with the slot 76 in the mounting member 50.

Figure 7:
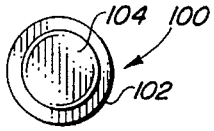
FIG. 7 is a plan view of a trigger button formed of three concentric, adjacent cylinders having different diameters.
Figure 8:
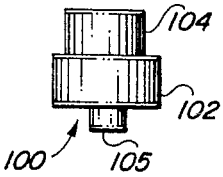
FIG. 8 is a side view of the trigger button illustrated in FIG. 7.

Referring now to FIGS. 7 and 8, a trigger button 100 is illustrated. The trigger button 100 is formed of three concentric, adjacent cylinders having different diameters. A larger diameter cylinder 102 is located behind a smaller diameter cylinder 104and a smaller diameter cylinder 105 is located behind cylinder 102. The diameter of the larger diameter cylinder 102 is slightly smaller than the diameter of the cylindrical aperture 52 in the mounting member 50 (FIG. 1). The diameter of the smaller diameter cylinder 104 is slightly smaller than the diameter of the cylindrical aperture 96 in the trigger coverplate 86 (FIG. 6).

Figure 9:
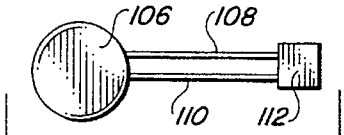
FIG. 9 is a is a plan view of a disc-shaped force sensing resistor having a pair of leads and a connector extending therefrom.
Figure 10:
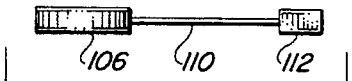
FIG. 10 is a side view of the force sensing resistor illustrated in FIG. 9.

Referring next to FIGS. 9 and 10, a disc-shaped force sensing resistor 106 is illustrated. The force sensing resistor 106 has a pair of leads 108 and 110 extending therefrom, which leads 108 and 110 are also connected to a connector 112. The force sensing resistor 106 is one of the key components of the present invention, and is a device which changes its resistance when a compressive force is applied to it. The resistance of the force sensing resistor 106 decreases as the compressive force exerted upon it increases. The force sensing resistor 106 is preferably a device such as the model number 302B force sensing resistor, which is available from Interlink Electronics.

Figure 11:
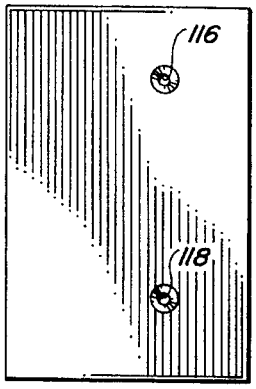
FIG. 11 is an end view of a bar end cap, showing two apertures therein which will be used to mount the bar end cap to the mounting member illustrated in FIGS. 1 through 5.
Figure 12:
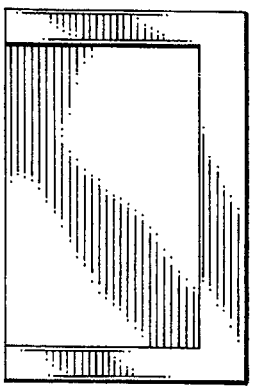
FIG. 12 is a back view of the bar end cap illustrated in FIG. 11.

Referring now to FIGS. 11 and 12, a bar end cap 114 is illustrated. The bar end cap 114 may be viewed as being a six-rectangular-sided shape with two adjacent sides being open, as better shown in FIG. 12. The bar end cap 114 has two countersunk apertures 116 and 118 located on the side illustrated in FIG. 11, which countersunk apertures 116 and 118 will be used to mount the bar end cap 114 to the mounting member 50 to retain a sensor bar (not shown) is position. When the bar end cap 114 is mounted onto the mounting member 50, the countersunk aperture 116 in the bar end cap 114 will be axially aligned with the threaded aperture 82 in the bracket end 78 of the mounting member 60, and the countersunk aperture 118 in the bar end cap 114 will be axially aligned with the threaded aperture 84 in the bracket end 80 of the mounting member 50.

Figure 13:
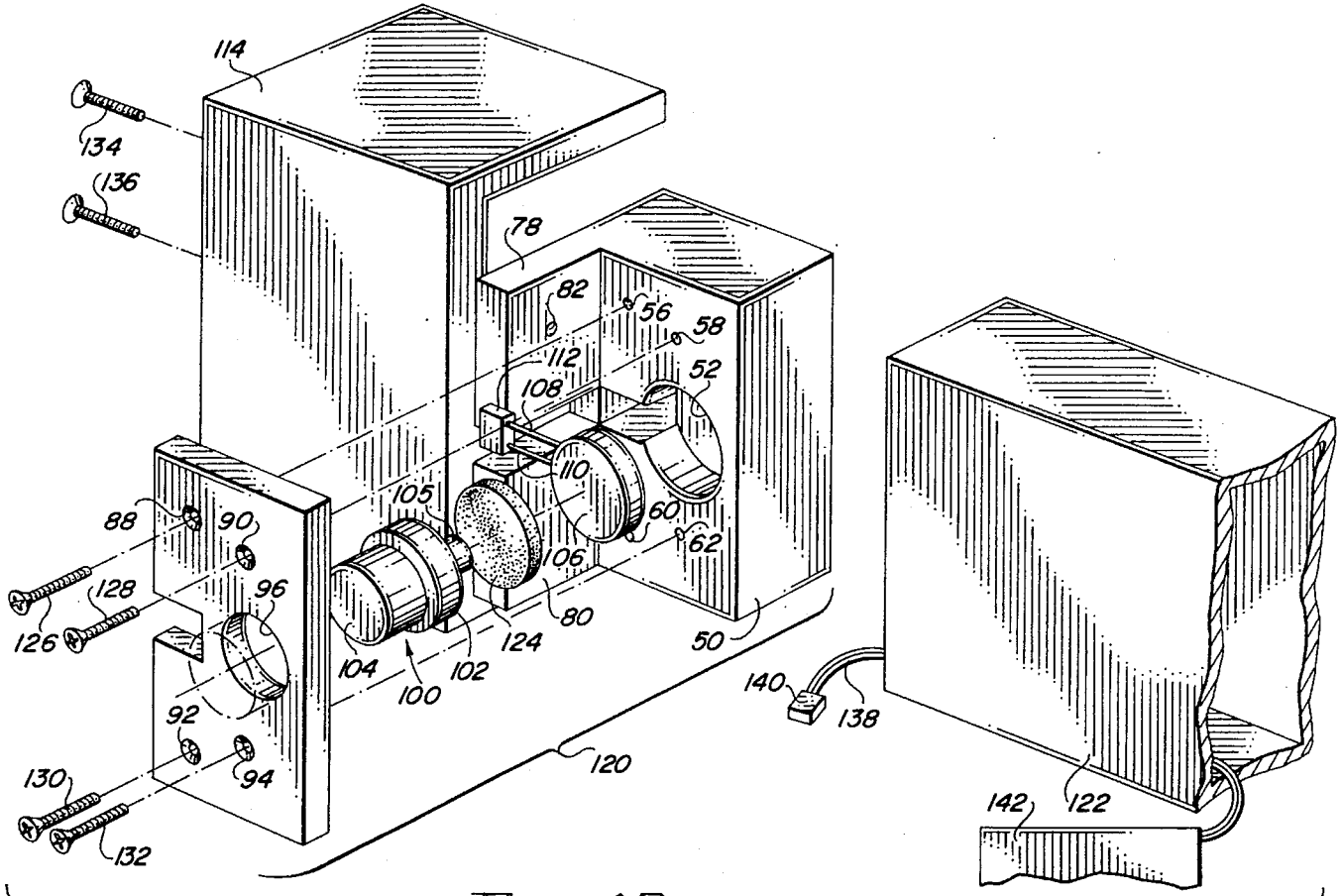
FIG. 13 is an isometric view of the components illustrated in FIGS. 1 through 12 and a silicone rubber disc being assembled together to form a sensor bar mounting assembly, which is used to support one end of a sensor bar.

Referring next to FIG. 13, a sensor bar mounting assembly 120 for supporting one end of a hollow, rectangular cross-section sensor bar 122 is illustrated. The components illustrated in FIGS. 1 through 12 together with a silicone rubber disc 124 may be assembled into the sensor bar mounting assembly 120 as shown. The function of the sensor bar mounting assembly 120 is to support one end of the hollow, rectangular cross-section sensor bar 122 in a manner whereby when the sensor bar 122 is pushed, it will cause the force sensing resistor 106 to have a compressive force exerted on it, changing its resistance.

The assembly of the components into the sensor bar mounting assembly 120 may now be described. The force sensing resistor 106 is placed into the cylindrical recess 52 in the mounting member 50, where it may, if desired, be adhesively secured in place.

The silicone rubber disc 124 is then placed into the cylindrical recess 52 in the mounting member 50, on top of the force sensing resistor 106. The silicone rubber disc 124 is made of resilient silicone rubber, which is in the preferred embodiment approximately one-sixteenth of an inch in thickness. The silicone rubber disc 124 functions as a spring.

The larger diameter cylinder 102 and smaller cylinder 105 of the trigger button 100 is then placed into the cylindrical recess 52 in the mounting member 50, on top of the silicone rubber disc 124. The trigger coverplate 86 is then placed against the mounting member 50, with the smaller diameter cylinder 104 of the trigger button 100 extending through the cylindrical aperture 96 in the trigger coverplate 86.

A flat head bolt 126 is inserted through the countersunk aperture 88 in the trigger coverplate 86, into the aperture 56 in the mounting member 50, where it is secured. A flat head bolt 128 is inserted through the countersunk aperture 90 in the trigger coverplate 86, into the aperture 58 in the mounting member 50, where it is secured.

A flat head bolt 130 is inserted through the countersunk aperture 92 in the trigger coverplate 86, and into the aperture 60 in the mounting member 50, where it is secured. A flat head bolt 132 is inserted through the countersunk aperture 94 in the trigger coverplate 86 into the tapped aperture 62 in the mounting member 50, where it is secured.

In this manner assembled, and when the larger diameter cylinder 102 of the trigger button 100, the silicone rubber disc 124, and the force sensing resistor 106 are all in contact and inserted fully into the cylindrical recess 52 in the mounting member 50, the smaller diameter cylinder 105 of the trigger button 100 will be spaced away from the trigger coverplate 86, and the smaller diameter cylinder 104 will extend out of the cylindrical aperture 96 in the trigger coverplate 86.

Thus, it will be appreciated that when the end of the sensor bar 122 is placed over the trigger coverplate 86, when the sensor bar 122 is pushed it will tend to depress the smaller diameter cylinder 104 of the trigger button 100, urging the smaller diameter cylinder 105 of the trigger button 100 into the silicone rubber disc 124, tending to exert a compressive force on the force sensing resistor 106 and thereby cause the force sensing resistor 106 to change its resistance.

With the sensor bar 122 so placed over the trigger coverplate 86, the bar end cap 114 is placed over the end of the sensor bar 122, in contact with the smaller diameter cylinder 104 of the trigger button 100. A flat head bolt 134 is inserted through the countersunk aperture 116 in the bar end cap 114, and into the threaded aperture 82 in the bracket end 78 of the mounting member 50, where it is secured. A flat head bolt 136 is inserted through the countersunk aperture 118 in the bar end cap 114, and into the threaded aperture 84 in the bracket end 78 of the mounting member 50, where it is secured. The bar end cap 114 thereby will retain the end of the sensor bar 122 in position on top of the trigger coverplate 86, and in contact with the smaller diameter cylinder 104 of the trigger button 100.

Note that a two conductor wire 138 having a connector 140 at one end thereof extends through the sensor bar 122. The connector 140 extends out of the end of the sensor bar 122 which is placed over the trigger coverplate 86. The connector 140 is connected to the connector 112, thereby connecting the electrical output of the force sensing resistor 106 to the two conductor wire 138. The two conductor wire 138 will supply the electrical output of the force sensing resistor 106 to a circuit board 142, which may be located inside the sensor bar 122.

It will be appreciated by those skilled in the art that two of the sensor bar mounting assemblies 120 are needed—one at each end of the sensor bar 122. Thus, when the sensor bar 122 is pushed, one or the other, or possibly both, of the force sensing resistors 106 located in the sensor bar mounting assemblies 120 at the opposite ends of the sensor bar 122 will provide an electrical output to the circuit board 142 which will cause the circuit board 142 to provide an output causing the door lock (not shown) on which the sensor bar mounting assemblies 120 and the sensor bar 122 are mounted to be unlocked.

Figure 14:
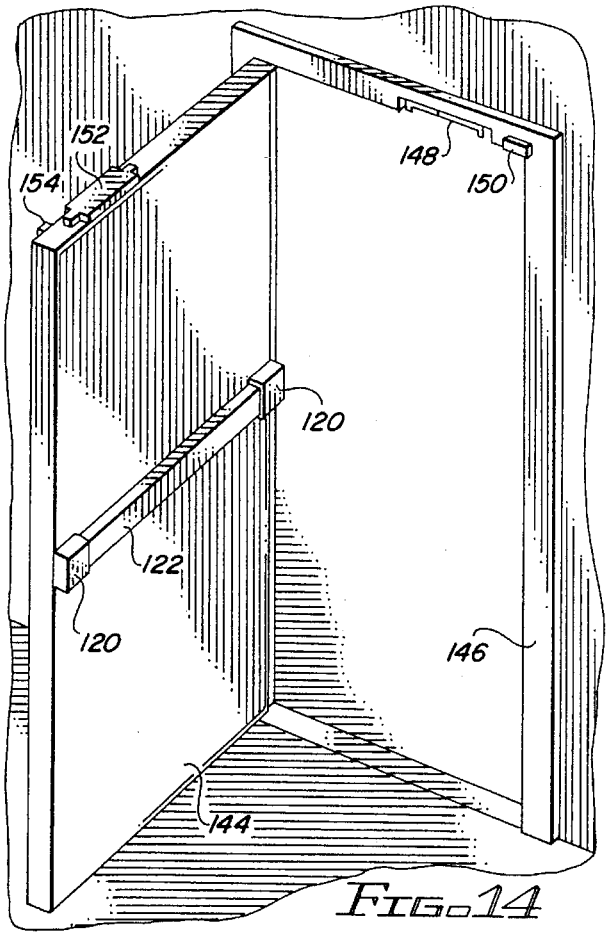
FIG. 14 is a perspective view of a door and a door frame, showing a door access bar consisting of the sensor bar mounted between two of the sensor bar mounting assemblies illustrated in FIG. 13 and installed on the door, and also showing a push bar electromagnetic locking system known in the art.

Referring now to FIG. 14, a door 144 is shown mounted in a door frame 146. An electromagnetic coil assembly 148 is mounted in the door frame 146, and a door switch actuator 150 may be mounted on the door frame 146. An armature 152 is mounted on the top of the door 144, and a door position switch 154 may be mounted on the door 144. The sensor bar 122 is shown mounted on the door 144 using two of the sensor bar mounting assemblies 120. Except for the sensor bar mounting assemblies 120 and the sensor bar 122 of the present invention, all of the components shown in FIG. 14 are conventional.

Figure 15:
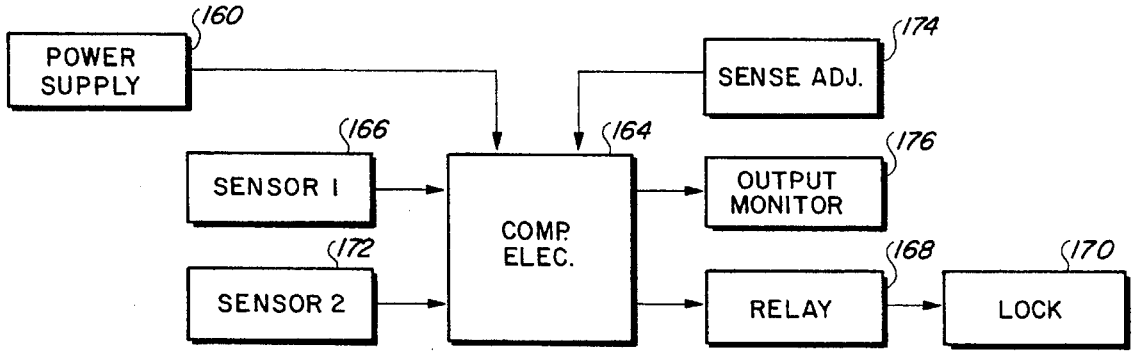
FIG. 15 is a functional schematic block diagram of an electromagnetic locking system using the force sensing resistors located in each of the mounting assemblies illustrated in FIG. 14 as inputs to trigger the unlocking of the lock retaining the door illustrated in FIG. 14 in the closed position.

Referring next to FIG. 15, a functional schematic block diagram of the electrical system operating the door lock shown in FIG. 14 is illustrated. The blocks shown in FIG. 15 all represent major system elements, some of which may be components discussed above. Before pointing out which of the elements in FIG. 15 are which of the components discussed above, the function of the system shown in FIG. 15 will be described.

A power supply 160 supplies electrical power to a comparator electronics 164. Typically, the power is low voltage DC, such as, for example 12 Volts DC. At least a first sensor 166 is used to provide an electrical input to the comparator electronics 164, which electrical input is indicative of force being placed on the sensor bar 122 (FIG. 14). When the comparator electronics 164 determines that the electrical input from the first sensor 166 is indicative of access or egress being requested.

A relay 168 normally functions to energize a lock 170, which, when energized, keeps the door locked. As such, the relay 168 is normally operated by the comparator electronics 164 to keep the lock 170 energized. However, when the relay 168 is actuated by the comparator electronics 164 to open the door, it deenergizes the lock 170, allowing the door to open.

Optionally, a second sensor 172 may be used by the system in addition to the first sensor 166. When either (or both) of the sensors 166 or 172 provide an electrical input to the comparator electronics 164 indicative of force being placed on the sensor bar 122 (FIG. 14), the comparator electronics 164 will cause the relay 168 to deenergize the lock 170.

Several other features may also optionally be included in the system. First, a sensor adjustment 174 may be added to control just how much (or, looking at it differently, just how little) force need be exerted on the sensors 166 and 172 in order to cause the comparator electronics 164 to operate the relay 168 to deenergize the lock 170, opening the door. Secondly, an output monitor 176 may be utilized to provide an indication at a remote location as to whether and when the comparator electronics 164 actuated the relay 168 to deenergize the lock 170, unlocking the door. The output monitor 176 may provide either a visual alarm or an audible alarm, or both.

In the above description, the comparator electronics 164, the relay 168, and the sensor adjustment 174 together comprise the circuit board 142, mentioned above in conjunction with FIG. 13. The sensors 166 and 172 each comprise one of the force sensing resistors 106, described above in conjunction with FIGS. 9, 10, and 13. The lock 170 comprises the electromagnetic coil assembly 148, described above in conjunction with FIG. 14.

Figure 16:
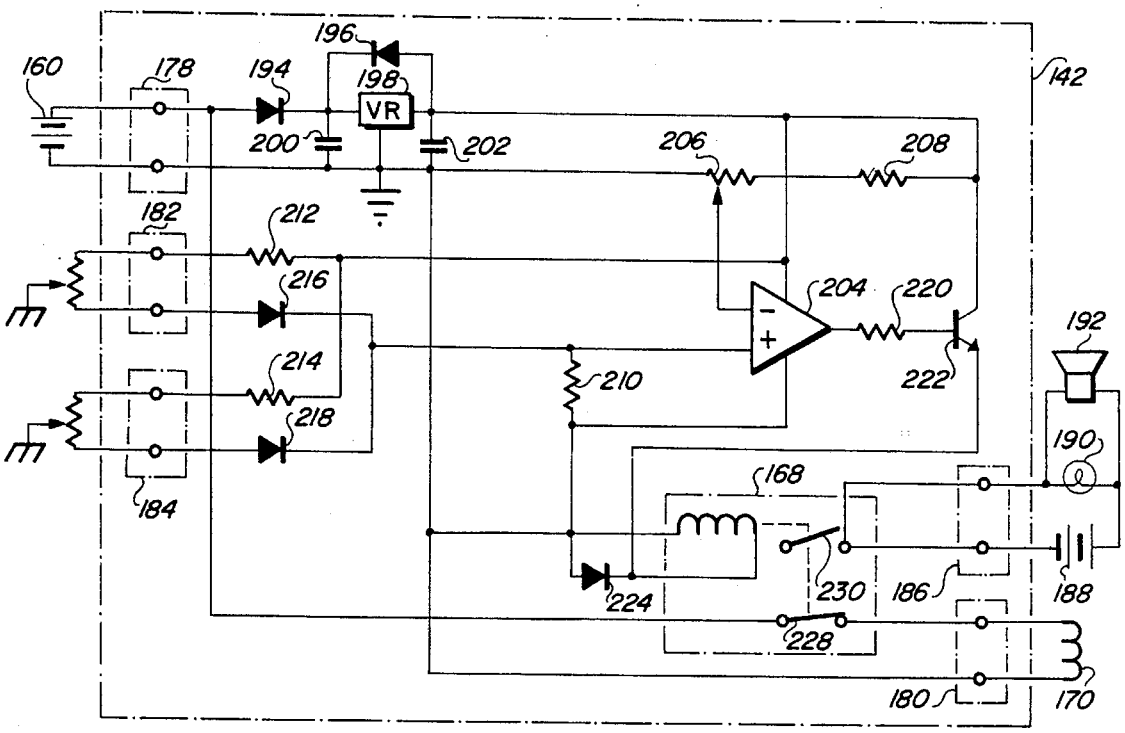
FIG. 16 is an electrical schematic of the electromagnetic locking system illustrated in functional schematic form in FIG. 15.

Referring now to FIG. 16, one possible electrical schematic is given for the system illustrated functionally in FIG. 15. The key elements of the system shown in FIG. 16 are the two sensors 166 and 172, which each comprise one of the force sensing resistors 106, and the circuit board 142, which comprises the comparator electronics 164, the relay 168, and the sensor adjustment 174, all of which are used to operate the lock 170, which comprises the electromagnetic coil assembly 148. Also shown in FIG. 16 as connected to the circuit board 142 is the power supply 160.

The circuit board 142 includes five pairs of terminal blocks 178, 180, 182, 184, and 186, which are used to connect the circuit board 142 to external components. The terminal blocks 178 are used to supply power to the system. One of the terminal blocks 178 is connected to the negative side of the power supply 160, and the other of the terminal blocks 178 is connected to the positive side of the power supply 160. The terminal blocks 180 are connected to the lock 170. The terminal blocks 182 are connected to the first sensor 166, and the terminal blocks 184 are connected to the second sensor 172.

Finally, one of the terminal blocks 186 is connected to one side of a monitor power source 188. The other of the terminal blocks 186 is connected to one side of a visual output indicator 190 and to one side of an audible output indicator 192. The other side of the monitor power source 188 is connected to the other side of the visual output indicator 190 and to the other side of the audible output indicator 192. The monitor power source 188, the visual output indicator 190, and the audible output indicator 192 together comprise the output monitor 176 of FIG. 15.

One of the terminal blocks 178 is the system ground of the circuit board 142. The other of the terminal blocks 178 is connected to the anode of a diode 194. The cathode of the diode 194 is connected to the cathode of a diode 196, to the input side of a voltage regulator 198, and to one side of a capacitor 200. The other side of the capacitor 200 and the ground connection of the voltage regulator 198 are both connected to the system ground of the circuit board 142. The anode of the diode 196 is connected to the output side of the voltage regulator 198, which is also connected to one side of a capacitor 202. The other side of the capacitor 202 is connected to the system ground of the circuit board 142.

The output side of the voltage regulator 198 and the system ground provide power for the other electronic components of the circuit illustrated in FIG. 16. These components used may be, for example, as follows. The diodes 194 and 196 may be 1N4002, 1 Amp diodes, the voltage regulator 198 may be a 5 Volt regulator such as an LM340-T5 regulator, the capacitor 200 may be a 47 microfarad, 50 Volt capacitor, and the capacitor 202 may be a 0.1 microfarad, 100 Volt capacitor.

The output side of the voltage regulator 198 and the system ground are connected to power a comparator 204. The comparator 204 may be an LM311N comparator. The inverting input of the comparator 204 will be connected to a variable reference voltage, which comprises the sensor adjustment 174 for the circuit. The noninverting input to the comparator 204 will be connected to accept the inputs from the first sensor 166 and the second sensor 172.

The sensor adjustment 174 utilizes a potentiometer 206 which is connected in series with a resistor 208. One side of the potentiometer 206 is connected to the system ground, and the other side of the potentiometer 206 is connected to one side of the resistor 208. The other side of the resistor 208 is connected to the output side of the voltage regulator 198. The center tap of the potentiometer 206 is connected to the inverting input of the comparator 204. By way of example, the potentiometer 206 may be a 500K Ohm potentiometer, and the resistor 208 may be a a 100K Ohm, ¼ Watt resistor.

A resistor 210 is connected between the noninverting input to the comparator 204 and the system ground. A resistor 212 is connected on one side thereof to the output side of the voltage regulator 198, and on the other side thereof to one side of the first sensor 166 via one of the terminal blocks 182. Similarly, a resistor 214 is connected on one side thereof to the output side of the voltage regulator 198, and on the other side thereof to one side of the second sensor 172 via one of the terminal blocks 184.

The anode of a diode 216 is connected to the other side of the first sensor 166 via the other of the terminal blocks 182. The anode of a diode 218 is connected to the other side of the second sensor 172 via the other of the terminal blocks 184. The cathodes of the diode 216 and the diode 218 are both connected to the noninverting input of the comparator 204. Thus, the first sensor 166 and the second sensor 172 will each be able to trigger the comparator 204 independently.

By way of example, the resistor 210 may be a 33K Ohm, ¼ Watt resistor, the diodes 216 and 218 may be 1N4002, 1 Amp diodes, and the resistors 212 and 214 may be 1K Ohm, ¼ Watt resistors.

The output of the comparator 204 is connected to one side of a resistor 220, the other side of which is connected to the base of an NPN transistor 222. The collector of the transistor 222 is connected to the output side of the voltage regulator 198. The emitter of the transistor 222 is connected to the cathode of a diode 224, and to one side of a coil 226, which is the coil of the relay 168. The anode of the diode 224 and the other side of the coil 226 are connected to the system ground.

The relay 168 is a double pole, single throw relay, with one normally closed switch 228 and one normally open switch 230, as shown in FIG. 16. Thus, when the coil 226 is energized, the normally closed switch 228 will be opened, and the normally open switch 230 will be closed. One side of the normally closed switch 228 is connected to the other of the terminal blocks 17S, which in turn is connected to the positive side of the power supply 160.

The other side of the normally closed switch 228 is connected to one side of the lock 170, (which comprises the electromagnetic coil assembly 148) via one of the terminal blocks 180. The other side of the lock 170 is connected to the system ground via the other of the terminal blocks 180. Thus, when the normally closed switch 228 is opened by energizing the coil 226 of the relay 168, the lock 170 will be deenergized, and will allow the door to be opened, By way of example, the resistor 220 may be a 470 Ohm, ¼ Watt resistor, the transistor 222 may be a 2N2222A NPN transistor, the diode 224 may be a 1N4002, 1 Amp diode, and the relay 168 may be a G6C-2114P 5 Volt relay.

The normally open switch 230 of the relay 168 is connected to components which together comprise the output monitor 176. One side of the normally open switch 230 is connected to the one of the terminal blocks 186, and the other side of the normally open switch 230 is connected to the other one of the terminal blocks 186. Thus, when the normally open switch 230 is closed by energizing the coil 226 of the relay 168, the visual output indicator 190 will provide a visual output, and the audible output indicator 192 will provide an audible output.

The operation of the circuit of FIG. 16 is quite simple. By adjusting the potentiometer 206, a reference voltage is set which is supplied to the inverting input of the comparator 204. When force is applied to either the first sensor 166 or the second sensor 172 (or to both of the sensors 166 and 172), the resistance across that sensor (or those sensors) drops. This causes the voltage across the resistor 210, which is applied to the noninverting input of the comparator 204, to increase.

When the voltage applied to the noninverting input of the comparator 204 reaches or exceeds the voltage applied to the inverting input of the comparator 204, the comparator 204 will provide an output which drives the transistor 222 to conduct, energizing the coil 226 in the relay 168. This causes the normally closed switch 228 to open, deenergizing the lock 170 and allowing the door to be opened. It also causes the normally open switch 230 to close, energizing the visual output indicator 190 and the audible output indicator 192 and thereby providing both a visual indication and an audible indication that the lock 170 has been deenergized, thereby allowing the door to be opened.

An alternate embodiment of the present invention is embodied in a push/pull door access handle illustrated in FIGS. 18 through 32. This door access handle may be used as the means to control the operation of an automatically opening door of the type used by handicapped individuals. When the door access handle is pulled, control circuitry connected to the door access handle provides a first electrical output signal indicating that a user is requesting that the door be opened. When the door access handle is pushed, the control circuitry connected to the door access handle provides a second electrical output signal indicating that the user is requesting that the opening of the door be stopped.

Figure 17:
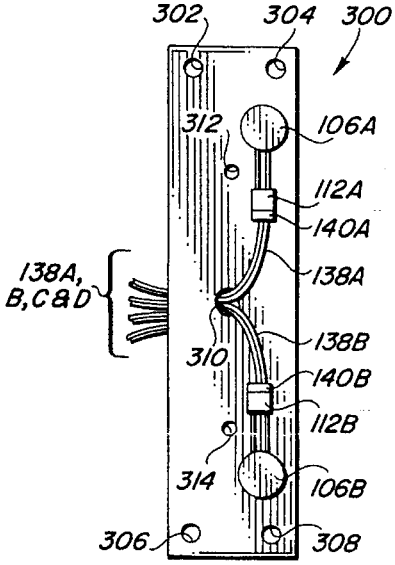
FIG. 17 is a front plan view of a flat sensor plate for use in a push/pull door access handle, showing a pair of force sensing resistors mounted on the front side of the sensor plate.
Figure 18:
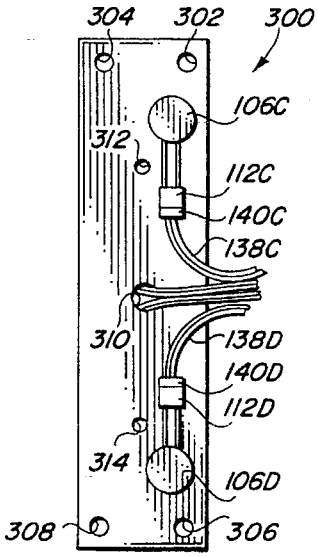
FIG. 18 is a back plan view of the sensor plate illustrated in FIG. 17, showing a pair of force sensing resistors mounted on the back side of the sensor plate.

Referring first to FIGS. 17 and 18, a flat sensor plate 300 is illustrated which is essentially rectangular in configuration. The sensor plate 300 is relatively thin but rigid, and has apertures 302, 304, 306, and 308 located near the four corners thereof, each of which apertures 302, 304, 306, and 308 extend through the sensor plate 300. Located in the center of the sensor plate 300 is an aperture 310, which extends therethrough. Located along the vertical axis of the sensor plate 300 are two countersunk apertures 312 and 314, which are countersunk on the back side of the sensor plate 300 as shown in FIG. 18. The countersunk aperture 312 is located intermediate the aperture 310 and the top edge of the sensor plate 300, and the countersunk aperture 314 is located intermediate the aperture 310 and the bottom edge of the sensor plate 300.

Mounted on the sensor plate 300 by means of adhesive are four of the force sensing resistors 106 illustrated in FIGS. 9 and 10. For purposes of reference herein, they are referred to as the force sensing resistor 106A, the force sensing resistor 106B, the force sensing resistor 106C, and the force sensing resistor 106D. The force sensing resistor 106A is located on the front side and nearer the top than the bottom of the sensor plate 300. The force sensing resistor 106B is located on the front side and nearer the bottom than the top of the sensor plate 300. The force sensing resistor 106C is located on the back side and nearer the top than the bottom of the sensor plate 300. The force sensing resistor 106D is located on the back side and nearer the bottom than the top of the sensor plate 300.

The connector 112A of the force sensing resistor 106A is connected via the connector 140A to the two conductor wire 138A. The connector 112B of the force sensing resistor 106B is connected via the connector 140B to the two conductor wires 138A and 138B. The two conductor wires 138A and 138B extend through the aperture 310 in the sensor plate 300 to the back side of the sensor plate 300. The connector 112C of the force sensing resistor 106C is connected via the connector 140C to the two conductor wire 138C. The connector 112D of the force sensing resistor 106D is connected via the connector 140D to the two conductor wire 138D.

Figure 19:
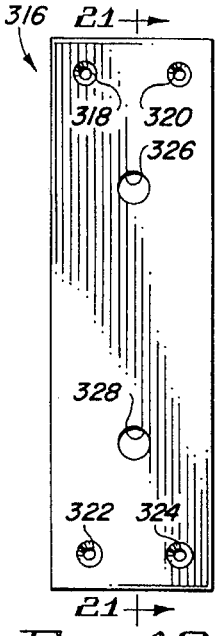
FIG. 19 is a front plan view of a front housing member showing four countersunk apertures and two larger apertures located therein.
Figure 20:
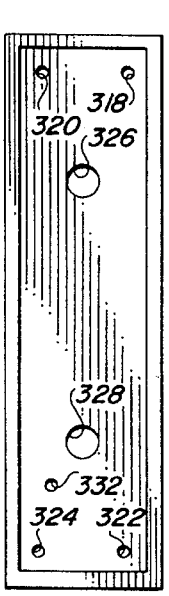
FIG. 20 is a back plan view of the front housing member illustrated in FIG. 19, showing the sides of the front housing member as well as the location of a pair of protrusions located on the back side of the front housing member.
Figure 21:
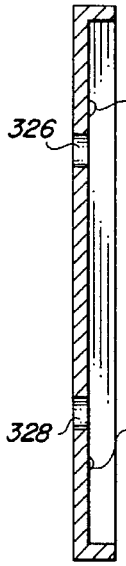
FIG. 21 is a cross-sectional view of the front housing member illustrated in FIGS. 19 and 20.

Referring next to FIGS. 19 through 21, a front housing member 316 is illustrated. The front housing member 316 has rearwardly projecting side walls about the outer periphery thereof, as best shown in FIGS. 20 and 21. The front housing member 316 has countersunk apertures 318, 320, 322, and 324 located near the side walls at the four corners thereof, each of which countersunk apertures 318, 320, 322, and 324 extend through the front housing member 316, and each of which countersunk apertures 318, 320, 322, and 324 are countersunk on the front side of the front housing member 316 as shown in FIG. 19. The countersunk apertures 318, 320, 322, and 324 are located to correspond in coaxial fashion with the apertures 302, 304, 306, and 308, respectively, in the sensor plate 300, which will be capable of fitting freely within the rearwardly projecting side walls of the front housing member 316.

Located along the vertical axis of the sensor plate 300 are two larger apertures 326 and 328. The larger aperture 326 is located intermediate the middle and the top edge of the front housing member 316, and the larger aperture 328 is located intermediate the middle and the bottom edge of the front housing member 316. The larger apertures 326 and 328 are located to correspond in coaxial fashion with the countersunk apertures 312 and 314, respectively, in the sensor plate 300.

Located on the back side of the front housing member 316 are two protrusions 330 and 332. The protrusion 330 is located to correspond in coaxial fashion with the center of the force sensing resistor 106A on the front side of the sensor plate 300 (FIG. 17) when the sensor plate 300 is located within the rearwardly projecting side walls of the front housing member 316. Similarly, the protrusion 332 is located to correspond in coaxial fashion with the center of the force sensing resistor 106B on the front side of the sensor plate 300 when the sensor plate 300 is located within the rearwardly projecting side walls of the front housing member 316. The protrusions 330 and 332 may be cylindrical projections extending rearwardly from the back face of the front housing member 316.

Figure 22:
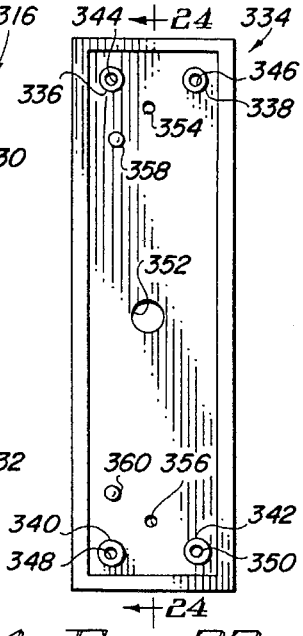
FIG. 22 is a front plan view of a back housing member, showing the sides of the back housing member, four forwardly-extending cylindrical posts having tapped apertures located therein, as well as the location of a pair of protrusions located on the front side of the back housing member.
Figure 23:
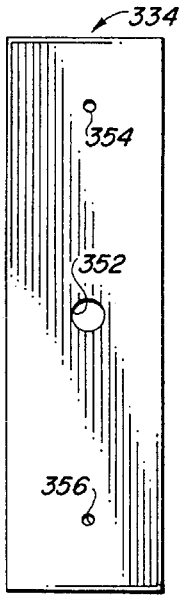
FIG. 23 is a back plan view of the back housing member illustrated in FIG. 22, showing the location of a pair of mounting apertures located therein, as well as the location of a larger aperture located therein.
Figure 24:
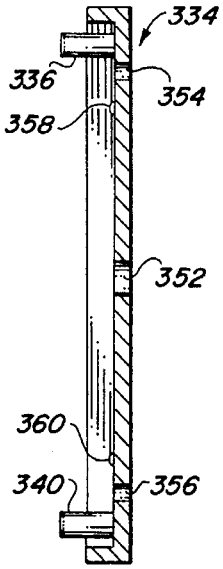
FIG. 24 is a cross-sectional view of the back housing member illustrated in FIGS. 22 and 23.

Referring now to FIGS. 22 through 24, a back housing member 334 is illustrated. The back housing member 334 has frontwardly projecting side walls about the outer periphery thereof, as best shown in FIGS. 22 and 24. The back housing member 334 has four forwardly-extending cylindrical posts 336, 338, 340, and 342 located near the side walls at the four corners thereof. The cylindrical posts 336, 338, 340, and 342 are located to correspond in coaxial fashion with the apertures 302, 304, 306, and 308, respectively, in the sensor plate 300, which will be capable of fitting freely within the rearwardly projecting side walls of the back housing member 334. The cylindrical posts 336, 338, 340, and 342 have tapped apertures 344, 346, 348, and 350, respectively, located therein.

Located in the center of the back housing member 334 is an aperture 352, which extends therethrough. Located along the vertical axis of the back housing member 334 are two tapped apertures 354 and 356. The tapped aperture 354 is located just below the level of the cylindrical posts 336 and 338 in the back housing member 334, and the tapped aperture 356 is located just above the level of the cylindrical posts 340 and 342 in the back housing member 334. The tapped apertures 354 and 356 will be used to mount the back housing member 334 onto a door (not shown).

Located on the front side of the back housing member 334 are two protrusions 358 and 360. The protrusion 358 is located to correspond in coaxial fashion with the center of the force sensing resistor 106C on the back side of the sensor plate 300 (FIG. 18) when the sensor plate 300 is located within the frontwardly projecting side walls of the back housing member 334. Similarly, the protrusion 360 is located to correspond in coaxial fashion with the center of the force sensing resistor 106D on the back side of the sensor plate 300 when the sensor plate 300 is located within the frontwardly projecting side walls of the back housing member 334. The protrusions 358 and 360 may be cylindrical projections extending frontwardly out from the front face of the back housing member 334.

Figure 25:
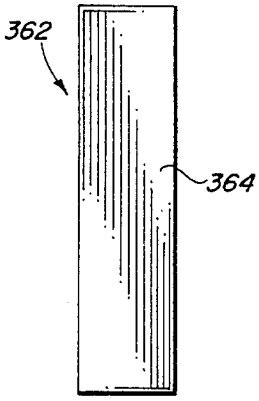
FIG. 25 is a front plan view of a sensor handle for use in a push/pull door access handle.
Figure 26:
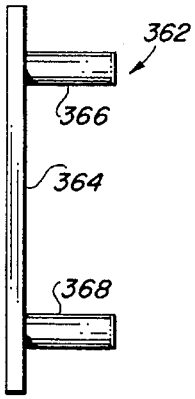
FIG. 26 is a side view of the sensor handle illustrated in FIG. 25, showing a pair of cylindrical posts extending from the back side thereof.
Figure 27:
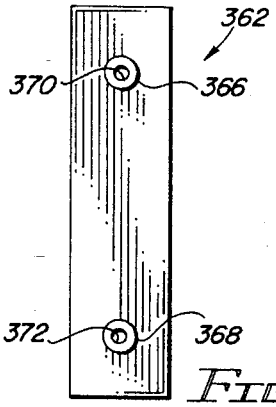
FIG. 27 is a back plan view of the sensor handle illustrated in FIGS. 25 and 26, showing threaded apertures located in the cylindrical posts.

Referring next to FIGS. 25 through 27, a sensor handle 362 is illustrated which consists of a plate member 364 having two cylindrical posts 366 and 368 extending from the back side thereof. The cylindrical posts 366 and 368 are located to correspond in coaxial fashion with the countersunk apertures 312 and 314 in the sensor plate 300 (FIG. 17). The cylindrical posts 366 and 368 have tapped apertures 370 and 372, respectively, located therein.

Figure 28:
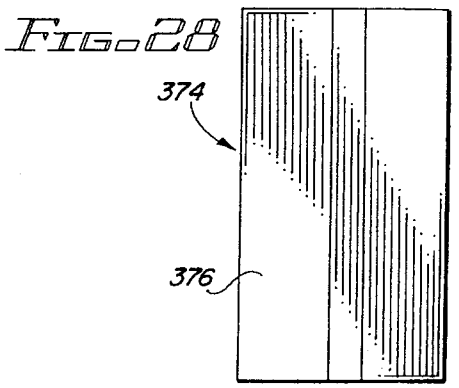
FIG. 28 is a front plan view of an alternate configuration sensor handle for use in a push/pull door access handle.
Figure 29:
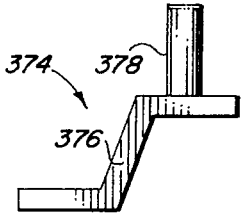
FIG. 29 is a top side view of the alternate configuration sensor handle illustrated in FIG. 28, showing a pair of cylindrical posts extending from the back side thereof.
Figure 30:
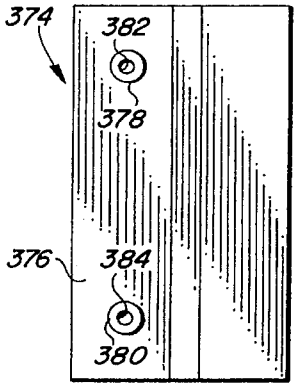
FIG. 30 is a back plan view of the alternate configuration sensor handle illustrated in FIGS. 28 and 29, showing threaded apertures located in the cylindrical posts.

Referring now to FIGS. 28 through 30, an alternate embodiment sensor handle 374 is illustrated which consists of a three segment zigzag-shaped plate member 376 having two cylindrical posts 378 and 380 extending from the back side thereof. The cylindrical posts 378 and 380 are located to correspond in coaxial fashion with the countersunk apertures 312 and 314 in the sensor plate 300 (FIG. 17). The cylindrical posts 378 and 380 have tapped apertures 382 and 384, respectively, located therein.

Figure 31:
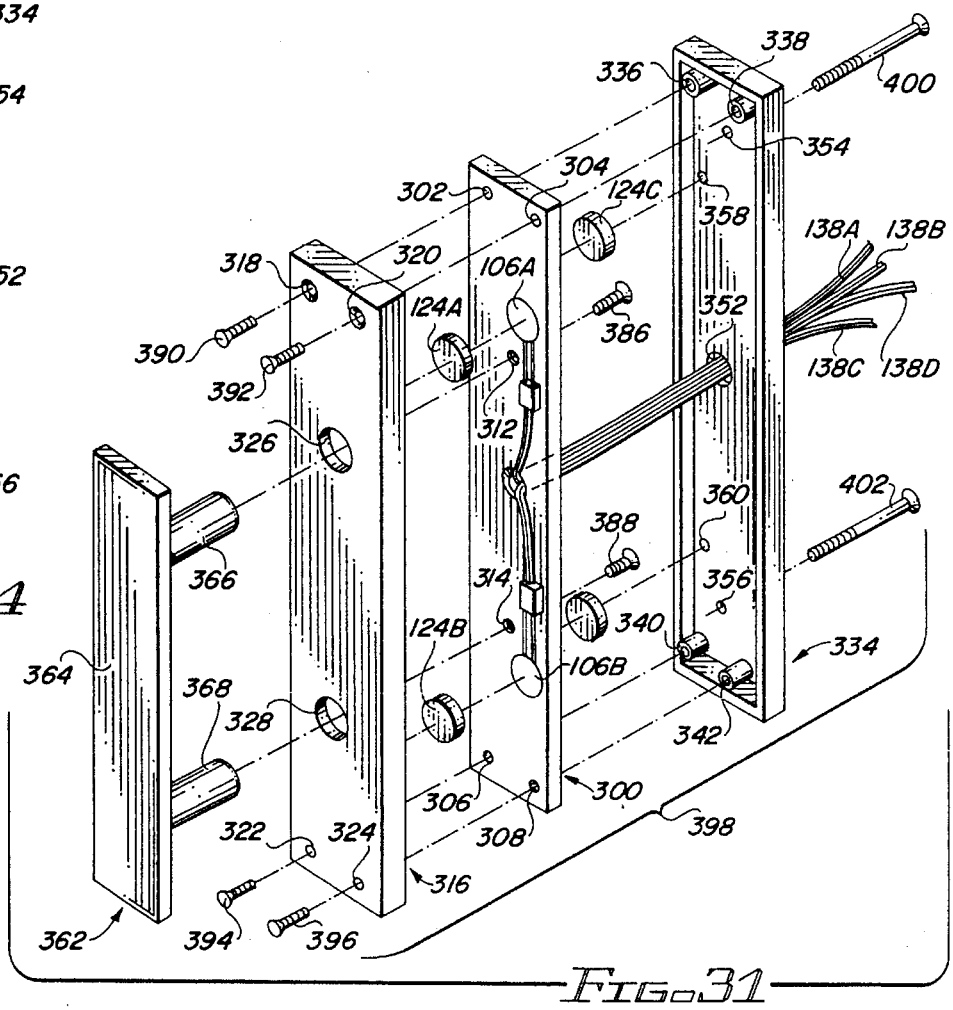
FIG. 31 is an isometric view of the components illustrated in FIGS. 17 through 27 being assembled into a push/pull door access handle.

Referring next to FIG. 31, the assembly of the components illustrated in FIGS. 17 through 27 is illustrated. It should be noted that the sensor handle 362 of FIGS. 28 through 30 may be used instead of the sensor handle 362 illustrated in FIGS. 25 through 27, if desired. Four silicone rubber discs 124A, 124B, 124C, and 124D are adhesively mounted onto the four force sensing resistors 106A, 106B, 106C, and 106D, respectively.

The cylindrical posts 366 and 368 of the sensor handle 362 are extended through the larger apertures 326 and 328, respectively, in the front housing member 316, and into place against the front side of the sensor plate 300 adjacent the countersunk apertures 312 and 314, respectively. Note that the outer diameters of each of the cylindrical posts 366 and 368 of the sensor handle 362 are slightly smaller than the diameters of the larger apertures 326 and 328 in the front housing member 316.

A flat head bolt 386 is inserted from the back side of the sensor plate 300 through the countersunk aperture 312, and into the tapped aperture 370 (FIG. 27) in the cylindrical post 366 of the sensor handle 362. A flat head bolt 388 is inserted from the back side of the sensor plate 300 through the countersunk aperture 314, and into the tapped aperture 372 (FIG. 27) in the cylindrical post 368 of the sensor handle 362. The sensor handle 362 is thus fixedly attached to the sensor plate 300.

Next, the two conductor wires 138A, 138B, 138C, and 138D are fed through the aperture 352 in the back housing member 334 from the front side to the back side thereof. The four cylindrical posts 336, 338, 340, and 342 of the back housing member 334 are inserted through the four apertures 302, 304, 306, and 306, respectively, in the sensor plate 300 from the back side to the front side thereof. Note that the outer diameters of each of the cylindrical posts 336, 338, 340, and 342 of the back housing member 334 are slightly smaller than the diameters of the apertures 302, 304, 306, and 306 in the sensor plate 300.

The four cylindrical posts 336, 338, 340, and 342 of the back housing member 334 are then placed against the back side of the front housing member 316 adjacent the countersunk apertures 318, 320, 322, and 324, respectively. A flat head bolt 390 is inserted from the front side of the front housing member 316 through the countersunk aperture 318, and into the tapped aperture 344 (FIG. 22) in the cylindrical post 336 of the back housing member 334. A flat head bolt 392 is inserted from the front side of the front housing member 316 through the countersunk aperture 320, and into the tapped aperture 346 (FIG. 22) in the cylindrical post 338 of the back housing member 334.

A flat head bolt 394 is inserted from the front side of the front housing member 316 through the countersunk aperture 322, and into the tapped aperture 348 (FIG. 22) in the cylindrical post 340 of the back housing member 334. A flat head bolt 396 is inserted from the front side of the front housing member 316 through the countersunk aperture 324, and into the tapped aperture 350 (FIG. 22) in the cylindrical post 342 of the back housing member 334.

This completes the assembly of a door access handle 398 as illustrated in FIG. 31. A pair of bolts 400 and 402 may be used to retain the door access handle 398 in place on a door (not shown) through use of the tapped apertures 354 and 356. When assembled the silicone rubber discs 124A and 124B will just contact the protrusions 330 and 332, respectively, on the back side of the front housing member 316. Similarly, the silicone rubber discs 124C and 124D will just contact the protrusions 358 and 360, respectively, on the front side of the back housing member 334.

When the plate member 364 is not being pulled away from the rest of the door access handle 398, the silicone rubber discs 124A and 124B will not be compressed against the protrusions 330 and 332, respectively, in the front housing member 316, and will not exert pressure on the force sensing resistors 106A and 106B, respectively. Similarly, when the plate member 364 is not being pushed toward the rest of the door access handle 398, the silicone rubber discs 124C and 124D will not be compressed against the protrusions 358 and 360, respectively, in the back housing member 334, and will not exert pressure on the force sensing resistors 106A and 106B, respectively.

When the plate member 364 is being pulled away from the rest of the door access handle 398, the silicone rubber discs 124A and 124B will be compressed against the protrusions 330 and 332, respectively, in the front housing member 316, and will exert pressure on the force sensing resistors 106A and 106B, respectively, causing the resistance of the force sensing resistors 106A and 106B to change. Similarly, when the plate member 364 is being pushed toward the rest of the door access handle 398, the silicone rubber discs 124C and 124D will be compressed against the protrusions 358 and 360, respectively, in the back housing member 334, and will exert pressure on the force sensing resistors 106A and 106B, respectively, causing the resistance of the force sensing resistors 106C and 106D to change.

Figure 32:
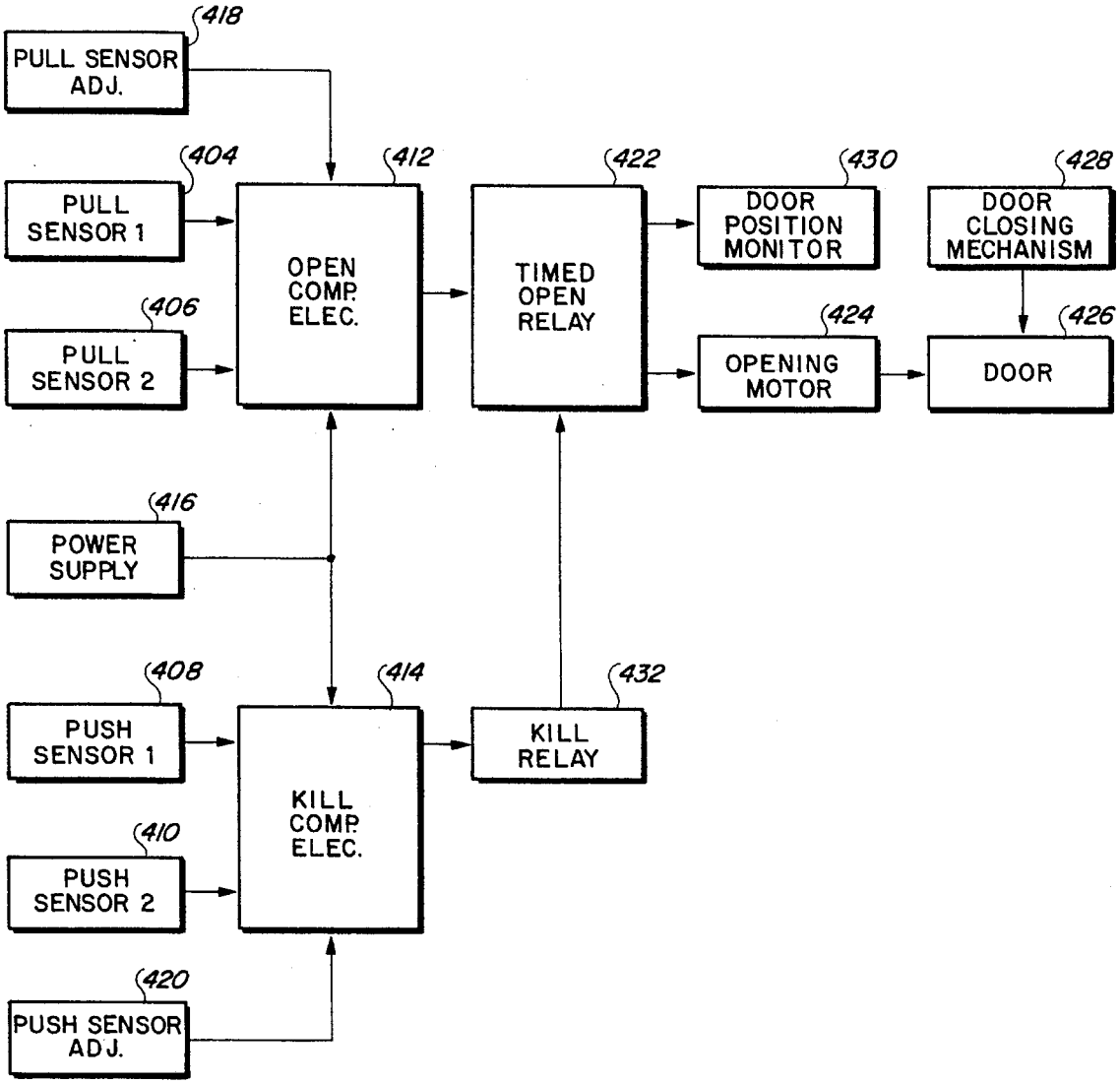
FIG. 32 is a functional schematic block diagram for a control system for operating an automatically opening door of the type used by handicapped individuals using the force sensing resistors located in the push/pull door access handle illustrated in FIG. 31 as inputs to control the operation of the automatically opening door.

Referring finally to FIG. 32, a functional schematic block diagram is shown for a control system which may be used to operate an automatically opening door of the type used by handicapped individuals. The control system uses the force sensing resistors 106A, 106B, 106C, and 106D located in the door access handle 398 illustrated in FIG. 31 as inputs to control the operation of the automatically opening door. The force sensing resistor 106A is shown in FIG. 32 as a first pull sensor 404, the force sensing resistor 106B is shown as a second pull sensor 406, the force sensing resistor 106C is shown as a first push sensor 408, and the force sensing resistor 106D is shown as a second push sensor 410.

The first pull sensor 404 and the second pull sensor 406 provide inputs to a door open comparator electronics 412, and the first push sensor 408 and the second push sensor 410 provide inputs to a door kill comparator electronics 414. Power is supplied to the door open comparator electronics 412 and the door kill comparator electronics 414 by a power supply 416. The power is typically low voltage DC, such as, for example 12 Volts DC.

A pull sensor adjustment 418 is used to control just how much (or, looking at it differently, just how little) pulling force need be exerted on the sensors 404 and 406 in order to cause the door open comparator electronics 412 to provide an output which will cause a door to be opened. Similarly, a push sensor adjustment 420 is used to control just mow much (or, looking at it differently, just how little) pushing force need be exerted on the sensors 408 and 410 in order to cause the door kill comparator electronics 414 to provide an output which will cause the opening of the door to be immediately ceased.

The output from the door open comparator electronics 412 is supplied to a timed open relay 422, which, when it receives the output from the door open comparator electronics 412, will cause an opening motor 424 to open a door 426. The door 426 may use a door closing mechanism 428 to close the door 426 whenever power is not being supplied by the timed open relay 422 to the opening motor 424.

The timed open relay 422 may advantageously have a timing period, during which it will supply power to the opening motor 424 to cause the door 426 to be opened and to remain open. After the timing period times out, power is no longer supplied from the timed open relay 422 to the opening motor 424, allowing the door closing mechanism 428 to close the door 426.

The timed open relay 422 may also drive a door position monitor 430 to provide an indication at a remote location as to whether and when the timed open relay 422 is supplying power to the opening motor 424 to cause the opening motor 424 to open the door 426. The door position monitor 430 may provide either a visual alarm or an audible alarm, or both.

The output from the door kill comparator electronics 414 is an indication that the user of the door access handle 398 (FIG. 31) desires to stop movement of the door 416. Accordingly, the output from the door kill comparator electronics 414 is supplied to a kill relay 432, which in turn will provide a signal to the timed open relay 422 causing it to immediately cease supplying power to the opening motor 424, even if the timed open relay 422 timing period has not timed out. This will immediately allow the door closing mechanism 428 to begin closing the door 426.

By adjusting the pull sensor adjustment 418 and the push sensor adjustment 420, the door access handle 398 (FIG. 31) can be made to be quite sensitive, requiring as little as two pounds of force to cause the door 426 to be opened, or to stop the opening of the door 426. This embodiment of the present invention thus provides an advantageous door control for use by handicapped individuals.

It may therefore be appreciated from the above detailed description of the preferred embodiment of the present invention that it teaches a door access bar which has a greatly improved electromechanical mechanism through which mechanical contact by a user with the door access bar is translated into an electrical output which may be utilized to initiate the process of unlocking the door on which the door access bar is located. In this regard, in the door access bar of the present invention, the Conventional limit switch mechanism has been replaced with a different type of switch mechanism which is more dependable and long lasting than conventional limit switches, and which also requires no adjustment throughout its lifetime.

The door access bar of the present invention also requires only minimal movement to initiate the electrical output indicating a desire for access or egress. In addition, the coiled springs conventionally used in door access bars have been eliminated in favor of an improved minimal movement mechanical design. Only a slight degree of force need be applied to the door access bar in order to obtain its electrical output. The minimum amount of force required to initiate the electrical output required to indicate a desire for access or egress is also fully adjustable over an appreciable range.

In another significant characteristic, the improved door access bar mechanism of the present invention is adaptable for use as a control mechanism for operating an automatically opening door of the type used by handicapped individuals. The switch mechanism contained in the door access bar is adaptable to manufacture as a push/pull door access handle which controls both the opening of a door when the door access handle is pulled, as well as the stopping, in an intermediate position, of the door when the door access handle is pushed. The adapted door access handle requires only a minimal force to actuate it in either the pushing movement or the pulling movement thereof, thereby safely meeting the needs of the handicapped, as well as meeting the requirements of The Americans With Disabilities Act.

The door access bar or handle of the present invention also is of a construction which is both durable and long lasting, and it also requires little or no maintenance to be provided by the user. It is of inexpensive construction, thereby affording it significant economic advantage and access to the broadest possible market. Finally, all of the aforesaid advantages and objectives of the present invention are achieved without incurring any substantial relative disadvantage.

Although an exemplary embodiment of the present invention has been shown and described with reference to particular embodiments and applications thereof, it will be apparent to those having ordinary skill in the art that a number of changes, modifications, or alterations to the invention as described herein may be made, none of which depart from the spirit or scope of the present invention. All such changes, modifications, and alterations should therefore be seen as being within the scope of the present invention.

What is claimed is:

1. A pressure-actuated door access device for controlling an electrically activated door control system for operating a door hingedly mounted in a door frame, said door access device comprising:

means for mounting said door access device on a mounting surface;

handle means for receiving a manual input, said handle means being installed adjacent said mounting means such that at least a portion of said mounting means is intermediate said handle means and said mounting surface;

a first transducer assembly for producing an electrical parameter, the value of which varies in response to pressure being applied across said first transducer assembly, said first transducer means being located intermediate said handle means and said mounting means such that said first transducer assembly is subjected to a compressive force when said handle means is pushed toward said mounting surface;

means for retaining said handle means in place adjacent said mounting means; and first monitoring means for monitoring said electrical parameter produced by said first transducer assembly and for providing a first output signal whenever said electrical parameter of said first transducer means means a first threshold, said first output signal being provided to the electrically activated control system to cause said electrically activated control system to operate the door in a first manner.

2. A door access device as defined in claim 1, wherein said electrically activated door control system is for selectively, alternatively electrically locking and unlocking the door, and wherein said handle means comprises:

a push bar to which a manual input may be applied to request access or egress through the door, said push bar having a first end thereof and a second end thereof, wherein said mounting means and the mounting surface are located on the door, said push bar thus being retained in place on the door by said retaining means, whereby said first output signal is provided to the electrically activated control system to cause said electrically activated control system to unlock the door.

3. A door access device as defined in claim 2, wherein said mounting means comprises:

a first mounting member for placement on the door, said first mounting means supporting said push bar at said first end thereof in a position adjacent said first mounting member; and a second mounting member for placement on the door, said second mounting member being spaced away from said first mounting member, said second mounting means supporting said push bar at said second end thereof in a position adjacent said second mounting member.

4. A door access device as defined in claim 3, wherein said retaining means comprises:

a first retaining member for retaining said first end of said push bar in position adjacent said first mounting member; and a second retaining member for retaining said second end of said push bar in position adjacent said second mounting member.

5. A door access device as defined in claim 3, wherein said first transducer assembly comprises:

a first transducer located intermediate said first end of said push bar and said first mounting member, said first transducer having said electrical parameter of said first transducer assembly; and a second transducer located intermediate said second end of said push bar and said second mounting member, said second transducer also having said electrical parameter of said first transducer assembly.

6. A door access device as defined in claim 5, wherein said first monitoring means monitors said electrical parameter of said first transducer as well as said electrical parameter of said second transducer, said first monitoring means providing said first output signal when either or both of said electrical parameter of said first sensor and said electrical parameter of said second sensor meet said first threshold.

7. A door access device as defined in claim 2, wherein said first monitoring means comprises:

means for providing a first reference signal;

means, connected to said first transducer assembly, for deriving a first variable signal which varies as a function of said electrical parameter of said first transducer assembly; and first comparing means for comparing said first variable signal and said first reference signal.

8. A door access device as defined in claim 7, wherein said first reference signal is a voltage, and wherein said first variable signal is a voltage dependent on said electrical parameter of said first transducer assembly.

9. A door access device as defined in claim 8, wherein said means for providing a first reference signal comprises:

a first fixed resistor; and a first potentiometer connected in series with said first fixed resistor, said first potentiometer having an adjustable first center tap, said first fixed resistor and said first potentiometer being for connection across a DC voltage source, said first reference signal being derived from said first center tap.

10. A door access device as defined in claim 8, wherein said first electrical parameter of said first transducer assembly comprises:

the electrical resistance exhibited by said first transducer assembly said first transducer assembly exhibiting an electrical resistance which varies depending on the amount of compressive force that said first transducer assembly is subjected to.

11. A door access device as defined in claim 10, wherein said means for deriving said first variable signal comprises:

a second fixed resistor connected in series with said first transducer means to thereby have a first common electrical node, said second fixed resistor and said transducer means being for connection across a DC voltage source, said first variable signal being derived from said first common electrical node.

12. A door access device as defined in claim 7, wherein said first comparing means provides said first output signal when said first reference signal is determined by said first comparing means to be greater than or equal to said first reference signal.

13. A door access device as defined in claim 2, wherein said first transducer assembly comprises:

a force sensing resistor, whereby said electrical parameter of said first transducer assembly comprises the resistance exhibited by said force sensing resistor, the resistance exhibited by said force sensing resistor varying depending on the amount of compressive force that said force sensing resistor is subjected to.

14. A door access device as defined in claim 2, wherein said push bar is hollow, and wherein said first monitoring means is located inside said push bar.

15. A door access device as defined in claim 2, additionally comprising:

means for varying said first threshold to thereby adjust the response in said electrical parameter of said first transducer required from first transducer assembly to meet said first threshold.

16. A door access device as defined in claim 2, additionally comprising:

first resilient means, located adjacent said first transducer means, for cushioning said first transducer means said first resilent means said push bar and said both being located intermediate said push bar and said mounting means.

17. A door access device as defined in claim 16, wherein said first resilient means is located adjacent said push bar and said first means is located adjacent said mounting means.

18. A door access device as defined in claim 17, additionally comprising:

an intermediate member disposed between said push bar and said first resilient means.

19. A door access device as defined in claim 16, wherein said first resilient means comprises:

a silicone rubber disc.

20. A door access device as defined in claim 2, additionally comprising:

means for providing an audible output or a visible output, or both an audible and a visible output, whenever said first monitoring means supplies said first output signal.

21. A door access device as defined in claim 1, wherein said electrically activated door control system is for selectively, alternatively, electrically activating and deactivating a motor for opening the door, wherein said door access device additionally comprises:

a second transducer assembly for producing an electrical parameter, the value of which varies in response to pressure being applied across said second transducer assembly, said second transducer assembly being located intermediate said handle means and said retaining means such that said second transducer assembly is subjected to a compressive force when said handle means is pulled away from said mounting surface; and second monitoring means for monitoring said electrical parameter produced by said second transducer assembly and for providing a second output signal whenever said electrical parameter of said second transducer assembly meets a second threshold, said second output signal being provided to the electrically activated control system to cause said electrically activated control system to activate the motor for opening the door; and wherein said handle means comprises:

a handle to which a manual input may be applied to request that the door be opened, wherein said mounting means and the mounting surface are located on the door, said handle thus being retained in place on the door by said retaining means, whereby said first output signal is provided to the electrically activated control system to cause said electrically activated control system to immediately deactivate the motor for opening the door.

22. A door access device as defined in claim 21, wherein said handle means additionally comprises:

a plate member having a front side thereof and a back side thereof, said plate member being spaced away from said handle by at least one spacer member, said back side of said plate member facing said mounting means, said front side of said plate member facing said retaining means, said first transducer means being located intermediate said back side of said plate member and said mounting means, said second transducer means being located intermediate said front side of said plate member and said retaining means.

23. A door access device as defined in claim 22, wherein said mounting means comprises:

a mounting member for placement on the door, said back side of said plate member facing said mounting member; and wherein said retaining means comprises:

a retaining member for attachment to said mounting member, said front side of said plate member facing said retaining member, said plate member thereby being retained intermediate said mounting member and said retaining member, said retaining member being located intermediate said handle and said plate member, said at least one space member extending through an aperture located in said retaining member.

24. A door access device as defined in claim 22, wherein said first transducer assembly comprises:

a first transducer located intermediate said plate member and said mounting means at a first location therebetween, said first transducer having said electrical parameter of said first transducer assembly; and a second transducer located intermediate said plate member and said mounting means at a second location therebetween, said second transducer also having said electrical parameter of said first transducer assembly; and wherein said second transducer assembly comprises:

a third transducer located intermediate said plate member and said retaining means at a third location therebetween, said third transducer having said electrical parameter of said second transducer means; and a fourth transducer located intermediate said plate member and said retaining means at a fourth location therebetween, said fourth transducer also having said electrical parameter of said second transducer assembly.

25. A door access device as defined in claim 24, wherein said first monitoring means monitors said electrical parameter of said first transducer as well as said electrical parameter of said second transducer, said first monitoring means providing said first output signal when either or both said electrical parameter of said first sensor and said electrical parameter of said second sensor meet said first threshold, and wherein said second monitoring means monitors said electrical parameter of said third transducer as well as said electrical parameter of said fourth transducer, said second monitoring means providing said second output signal when either or both said electrical parameter of said third sensor and said electrical parameter of said fourth sensor meet said second threshold.

26. A door access device as defined in claim 22, wherein said first monitoring means comprises:

means for providing a first reference signal;

means, connected to said first transducer assembly, for deriving a first variable signal which varies as a function of said electrical parameter of said first transducer assembly; and first comparing means for comparing said first variable signal and said first reference signal; and wherein said second monitoring means comprises:

means for providing a second reference signal;

means, connected to said second transducer assembly, for deriving a second variable signal which varies as a function of said electrical parameter of said second transducer assembly; and second comparing means for comparing said second variable signal and said second reference signal.

27. A door access device as defined in claim 26, wherein said first and second reference signals are voltages, and wherein said first variable signal is a voltage dependent on said electrical parameter of said first transducer assembly, and wherein said second variable signal is a voltage dependent on said electrical parameter of said second transducer assembly.

28. A door access device as defined in claim 27, wherein said means for providing a first reference signal comprises:

a first fixed resistor; and a first potentiometer connected in series with said first fixed resistor, said first potentiometer having an adjustable first center tap, said first fixed resistor and said first potentiometer being for connection across a DC voltage source, said first reference signal being derived from said first center tap; and wherein said means for providing a second reference signal comprises:

a second fixed resistor; and a second potentiometer connected in series with said second fixed resistor, said second potentiometer having an adjustable second center tap, said second fixed resistor and said second potentiometer being for connection across a DC voltage source, said second reference signal being derived from said second center tap.

29. A door access device as defined in claim 27, wherein said first electrical parameter of said first transducer assembly comprises:

the electrical resistance exhibited by said first transducer assembly, said first transducer assembly exhibiting an electrical resistance which varies depending on the amount of compressive force that said first transducer means is subjected to; and wherein said second electrical parameter of said second transducer assembly comprises:

the electrical resistance exhibited by said second transducer assembly, said second transducer means exhibiting an electrical resistance which varies depending on the amount of compressive force that said second transducer assembly is subjected to.

30. A door access device as defined in claim 29, wherein said means for deriving said first variable signal comprises:

a third fixed resistor connected in series with said first transducer means to thereby have a first common electrical node, said third fixed resistor and said transducer means being for connection across a DC voltage source, said first variable signal being derived from said first common electrical node; and wherein said means for deriving said second variable signal comprises:

a fourth fixed resistor connected in series with said first transducer means to thereby have a second common electrical node, said fourth fixed resistor and said transducer means being for connection across a DC voltage source, said second variable signal being derived from said second common electrical node.

31. A door access device as defined in claim 26, wherein said first comparing means provides said first output signal when said first reference signal is determined by said first comparing means to be greater than or equal to said first reference signal; and wherein said second comparing means provides said second output signal when said second reference signal is determined by said second comparing means to be greater than or equal to said second reference signal.

32. A door access device as defined in claim 22, wherein said first transducer assembly comprises:

a first force sensing resistor, whereby said electrical parameter of said first transducer assembly comprises the resistance exhibited by said first force sensing resistor, the resistance exhibited by said first force sensing resistor varying depending on the amount of compressive force that said first force sensing resistor is subjected to; and wherein said second transducer assembly comprises:

a second force sensing resistor, whereby said electrical parameter of said second transducer assembly comprises the resistance exhibited by said second force sensing resistor, the resistance exhibited by said second force sensing resistor varying depending on the amount of compressive force that said second force sensing resistor is subjected to.

33. A door access device as defined in claim 22, additionally comprising:

means for varying said first threshold to thereby adjust the response in said electrical parameter of said first transducer required from first transducer assembly to meet said first threshold; and means for varying said second threshold to thereby adjust the response in said electrical parameter of said second transducer required from second transducer assembly to meet said second threshold.

34. A door access device as defined in claim 22, additionally comprising:

first resilient means, located adjacent said first transducer means, for cushioning said first transducer means, said first resilient means and said first transducer means both being located intermediate said plate member and said mounting means; and second resilient means, located adjacent said second transducer means, for cushioning said second transducer means, said second resilient means and said second transducer means both being located intermediate said plate member and said retaining means.

35. A door access device as defined in claim 34, wherein said first resilient means is located adjacent said mounting means and said first transducer means is located adjacent said plate member, and wherein said second resilient means is located adjacent said retaining means and said second transducer means is located adjacent said plate member.

36. A door access device as defined in claim 34, wherein said first and second resilient means each comprise:

a silicone rubber disc.

37. A door access device as defined in claim 22, additionally comprising:

means for providing an audible output or a visible output, or both an audible and a visible output, whenever said second monitoring means supplies said first output signal.

38. A door access device as defined in claim 22, wherein said handle is essentially flat and rectangular in configuration.

39. A door access device as defined in claim 22, wherein said handle comprises:

a three segment zigzag-shaped plate member.

40. A pressure-actuated door access device for controlling an electrically activated door control system for selectively, alternatively electrically locking and unlocking a door hingedly mounted in a door frame, said door access device comprising:

a first mounting member for mounting said door access device on the door;

a second mounting member for mounting said door access device on the door;

a push bar for receiving a manual input, said push bar having a first end thereof and a second end thereof;

a first retaining member, said first end of said push bar being retained between said first mounting member and said first retaining member;

a second retaining member, said second end of said push bar being retained said second mounting member and said second retaining member;

a first transducer for producing an electrical parameter, the value of which varies in response to pressure being applied across said first transducer, said first transducer being located intermediate said first end of said push bar and said first mounting member such that said first transducer is subjected to a compressive force when said push bar is pushed toward the door;

a second transducer for producing an electrical parameter, the value of which varies in response to pressure being applied across said second transducer, said second transducer being located intermediate said second end of said push bar and said second mounting member such that said second transducer is subjected to a compressive force when said push bar is pushed toward the door; and monitoring means for monitoring said electrical parameter produced by said first and second transducers and for providing a first output signal whenever said electrical parameter of either or both of said first and second transducers meets a first threshold, said first output signal being provided to the electrically activated control system to cause said electrically activated control system to unlock the door.

41. A pressure-actuated door access device for controlling an electrically activated door control system to selectively, alternatively electrically activate and deactivate a motor to open a door hingedly mounted in a door frame, said door access device comprising:

a mounting member for mounting said door access device on a mounting surface;

a handle for receiving a manual input;

a plate member having a front side thereof and a back side thereof, said plate member being operatively connected to said handle by at least one spacer member such that said plate member is spaced away from said handle, said back side of said plate member facing said mounting member;

a retaining member located intermediate said handle and said plate member, said retaining member retaining said plate member in place adjacent said mounting member, said front side of said plate member facing said retaining member;

first transducer assembly for producing an electrical parameter, the value of which varies in response to pressure being applied across said first transducer means, said first transducer means being located intermediate said back side of said plate member and said mounting apparatus such that said first transducer assembly is subjected to a compressive force when said handle is pushed toward said mounting surface;

second transducer assembly for producing an electrical parameter, the value of which varies in response to pressure being applied across said second transducer assembly, said second transducer means being located intermediate said front side of said plate member and said retaining member such that said second transducer assembly is subjected to a compressive force when said handle is pulled away from said mounting surface;

first monitoring means for monitoring said electrical parameter produced by said first transducer assembly and for providing a first output signal whenever said electrical parameter of said first transducer assembly meets a first threshold, said first output signal being provided to the electrically activated control system to cause the electrically activated control system to immediately deactivate the motor for opening the door; and second monitoring means for monitoring said electrical parameter produced by said second transducer assembly and for providing a second output signal whenever said electrical parameter of said second transducer assembly meets a second threshold, said second output signal being provided to the electrically activated control system to cause the electrically activated control system to activate the motor for opening the door.

42. A pressure activated door access device comprising:

a) a door;

b) an actuator mounted on said door;

c) a pressure transducer connected to said actuator which produces an electrical parameter which varies in response to actuator pressure being applied to said pressure transducer; and, d) an electromechanical locking means associated with said door responsive to said electrical parameter produced by said pressure transducer in response to pressure being applied to said actuator to allow opening of said door.

* * * * *